US006317898B1

(12) United States Patent
Mehta

(10) Patent No.: US 6,317,898 B1
(45) Date of Patent: Nov. 20, 2001

(54) APPARATUS FOR SELECTING MARINE TOILET FLUSH WATER

(75) Inventor: Vinod K. Mehta, Pittsgrove, NJ (US)

(73) Assignee: Raritan Engineering Company, Inc., Millville, NJ (US)

( * ) Notice: Subject to any disclaimer, the term of this patent is extended or adjusted under 35 U.S.C. 154(b) by 0 days.

(21) Appl. No.: 09/513,092

(22) Filed: Feb. 25, 2000

(51) Int. Cl.[7] ..... E03D 1/00
(52) U.S. Cl. ..... 4/321; 4/300; 4/353
(58) Field of Search ..... 4/366, 321, 323, 4/431, 432, 433, 434, 435; 114/197, 198, 74 R

(56) References Cited

U.S. PATENT DOCUMENTS

| | | | | |
|---|---|---|---|---|
| 3,154,796 | * | 11/1964 | Bruce | 4/431 |
| 3,535,712 | * | 10/1970 | Zeff et al. | 4/317 |
| 3,593,346 | | 7/1971 | Katona | 4/10 |
| 3,611,447 | | 10/1971 | Howard | 4/10 |
| 3,780,383 | | 12/1973 | Katona | 4/10 |
| 3,815,159 | | 6/1974 | Delaney et al. | 4/10 |
| 3,927,425 | | 12/1975 | Delaney et al. | 4/10 |
| 4,306,321 | * | 12/1981 | Norlin | 4/321 |
| 4,433,443 | | 2/1984 | DeGraw et al. | 4/317 |
| 4,454,613 | | 6/1984 | Palmer | 4/300 |
| 4,819,279 | * | 4/1989 | Sigler et al. | 4/300 |
| 5,142,707 | * | 9/1992 | Prue | 4/222 |
| 5,369,811 | * | 12/1994 | Serre | 4/431 |
| 5,711,038 | | 1/1998 | Niethammer et al. | 4/317 |
| 6,085,366 | * | 7/2000 | Pondelick et al. | 4/431 |

* cited by examiner

*Primary Examiner*—Gregory L. Huson
*Assistant Examiner*—Huyen Le
(74) *Attorney, Agent, or Firm*—Robert S. Lipton, Esq.; Lipton, Weinberger & Husick

(57) ABSTRACT

An apparatus is provided for selecting either potable water or seawater as flush water for marine sanitary toilets. The apparatus may be designed to be electrically or manually operated. Check valves and vaccum breaker prevent contamination or waste of the potable water supply.

24 Claims, 5 Drawing Sheets

APPARATUS FOR SELECTING MARINE TOILET FLUSH WATER

BACKGROUND OF THE INVENTION

1. Field of the Invention

The present invention relates to an apparatus for selecting among multiple sources of flush water for a toilet, such as a marine toilet, while avoiding contamination of the flush water sources. The multiple sources of flush water for a marine toilet may include potable water and may include seawater. For the purposes of this application, the term "seawater" means any water in which the vessel floats, whether the water is lake or salt.

2. Description of the Prior Art

The design of sewage systems for use aboard marine vessels presents a tension between aesthetics and space limitations. Odor is always an issue concerning sewage disposal, and the use of potable water for flushing waste from toilets is preferred to other flushing media such as recirculated wastewater or seawater due to the lower potential for odor presented by potable water. However, space to store potable water is scarce on a marine vessel. It is desirable, therefore, to use a source other than potable water to flush wastes from a marine toilet while a vessel is away from port. In port, a vessel may be connected to a land-based potable water system and the need to conserve potable water is reduced.

The present invention provides that the flushing medium readily may be selected either as seawater or as potable water. The invention allows the avoidance of unnecessary odor in port, where an ample supply of potable water is available, and allows a vessel to avoid storage of unnecessary quantities of potable water while away from port.

Toilets used in marine vessels such as personal yachts and pleasure craft typically utilize either manual or electrical pumps to supply a source of flush water. Popular models of electrically operated marine toilets include (but not limited to) the Atlantes™ and Crown Head II™ and rely upon flush water supplied to the toilet under pressure by an electrically operated pump. Manual toilets may use a manually operated piston pump to pump seawater into the toilet and sewage out of the toilet. In the piston pump toilets, one side of the pump piston is used to supply a positive pressure to pump the seawater into the toilet bowl. The second side of the pump piston is used to supply a negative pressure to the sewage in the toilet bowl, clearing the bowl and allowing the sewage to flow to a holding tank.

Toilets used in marine vessels generally use either potable water or seawater to flush waste from the toilet bowl and into holding tanks or treatment system. The flush water and the collected wastes are removed from the holding tanks when the vessel is in port. The prior art toilets and marine sewage systems do not allow selection between seawater and potable water as flushing media. The prior art toilets and marine sewage systems therefore are susceptible to the odor and potable water storage deficiencies discussed above.

Several devices have been developed to address these problems. U.S. Pat. No. 3,593,346 to Katona issued Jul. 20, 1970 provides for the selectable use of recirculated sewage or potable water as flushing media for vehicle toilets. Recirculation of sewage, while space-efficient, exacerbates the problem of odor. The 346 Katona patent does not provide for selecting either seawater or potable water as the flushing media.

U.S. Pat. No. 3,611,447 to Howard, issued Oct. 12, 1971 addresses the odor problem caused by recirculated sewage used as flush water. Howard provides two sequential toilet bowls separated by valves. The first bowl is flushed with potable water and the second is flushed with recirculated sewage. Howard does not provide for selecting either seawater or potable water as the flushing media.

U.S. Pat. No. 3,780,383 to Katona issued Dec. 25, 1973 is based on a divisional application and includes the same disclosure as the 346 Katona patent. The 383 Katona patent teaches a folding toilet with a bowl that drains into a second bowl when the toilet is folded. Both bowls are flushed selectively with treated wastewater or "running water." The 383 Katona patent does not provide for selecting either seawater or potable water as the flushing media.

U.S. Pat. No. 3,815,159 to Delaney issued Jun. 11, 1974 and related U.S. Pat. No. 3,927,425 to Delaney issued Dec. 23, 1975 reveal a sewage system for marine vessels using recirculated treated sewage for the flushing of toilets. The Delaney patents do not provide for selective use of seawater or potable water as the flushing media.

U.S. Pat. No. 4,433,443 to DeGraw issued Feb. 28, 1984 reveals a marine sewage system using seawater for flushing of toilets. A removable filter cassette collects solid wastes from the seawater and the contaminated seawater is treated by an "electrolytic cell." The treated seawater is then discharged to the sea. DeGraw does not provide for selection between seawater and potable water for the flushing of toilets.

U.S. Pat. No. 4,454,613 to Palmer reveals a sewage system for travel trailers and allows flushing of toilets using either potable water or non-sewage wastewater. Palmer does not teach selectable use of seawater or potable water for flushing of toilets.

U.S. Pat. No. 5,711,038 to Neithammer dated Jan. 27, 1998 reveals a toilet for vehicles where solid wastes are separated from liquid wastes, the liquid wastes are disinfected and used for flushing toilets. Neithammer does not teach selectable use of seawater or potable water for flushing toilets.

The apparatus of the present invention offers advantages over the prior art. The prior art marine sewage systems neither teach nor suggest the selectable use of seawater or potable water as a flushing media. The prior marine sewage systems do not teach or suggest the use of the valving and related system of the present invention to allow selectable interconnection of seawater systems and potable water systems for the flushing of toilets while avoiding contamination of either system.

SUMMARY OF THE INVENTION

The apparatus of the present invention allows selection of either seawater or potable water for flushing one or more toilets on a marine vessel. The selection of potable water as the flushing water allows prevention of odors while a vessel is in port and potable water is plentiful. The selection of seawater as the flushing water allows for the conservation of scarce potable water while the vessel is away from port. The selectable use of sea water or potable water also provides redundancy and a reliable supply of toilet flush water in the event that one source or the other should fail to function.

The selection between seawater and potable water may be effected either electrically or manually, or by a combination of the two methods. When the selection is accomplished electrically, the selection may be effected by the operation of a single electrical switch. The electrical switch energizes electrical circuits for appropriate solenoid valves and pumps. The activated solenoid valves open a hydraulic path to the selected flush water. The energized pump circuit is available to pump the selected flush water to the toilet when activated by the person using the toilet. Redundant check valves prevent contamination of the potable water supply by seawater. An appropriate atmospheric vacuum breaker prevents contamination of the flush water supply lines by seawater. If the toilet is installed below the water line of a vessel, an appropriate vented loop prevents overflow of the toilet from the static pressure of the seawater when seawater is selected as the flush water. An appropriate strainer may be installed on the seawater intake line to remove objects from the seawater and to reduce odors and deposits in the toilet.

DESCRIPTION OF THE PREFERRED EMBODIMENT

Figure 1:
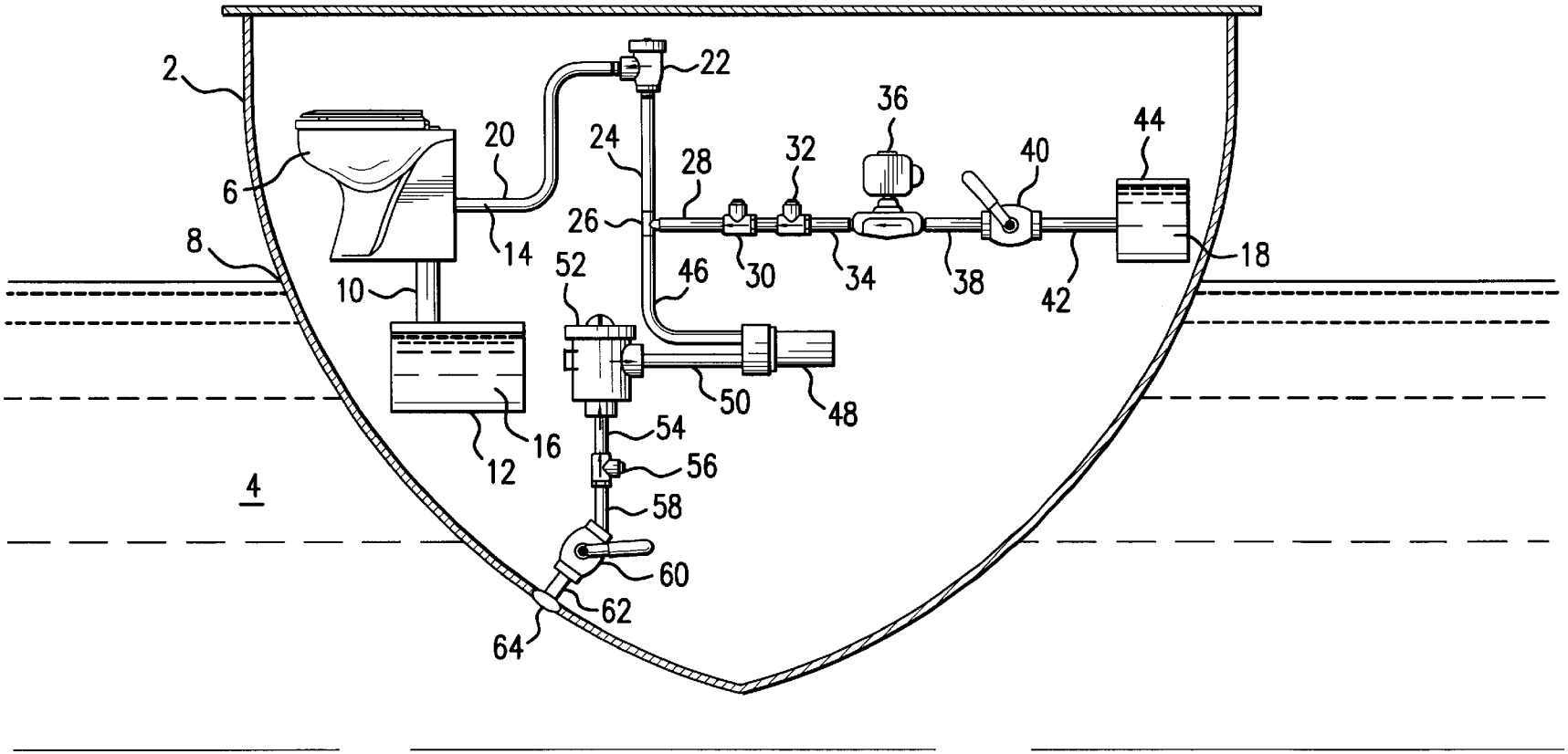
FIG. 1 is a plumbing diagram of the preferred embodiment where the toilet is installed above the water line of a marine vessel.

FIG. 1 is a plumbing diagram of the preferred embodiment. In FIG. 1, a marine vessel 2 floats in seawater 4. A marine toilet 6, such as the Atlantes™ or Crown Head II™, is mounted above the waterline 8 as determined by the angle of maximum heel of the vessel 2. The toilet 6 discharges sewage 16 to a toilet discharge line 10 and hence to a sewage holding tank 12. Sewage 16 is pumped from the holding tank 12 when the vessel 2 is in port and disposed in a land-based sewage treatment system.

Flush water 14, selectably comprising either seawater 4 or potable water 18, is delivered to the toilet 6 through a flush water supply line 20. A vacuum breaker 22 prevents a vacuum from drawing sewage 16 from the toilet 6 and contaminating potable water 18 or seawater 4. A vacuum breaker supply line 24 transmits the flush water 14 from "T" connector 26.

When potable water 18 is selected, potable water "T" connector supply line 28 transmits potable water 18 from a first potable water check valve 30 to "T" connector 26. The first potable water check valve 30 prevents flow of either sewage 16 or seawater 4 to potable water supply 44 and prevents contamination of potable water 18. Second potable water check valve 32 is connected in series with first potable water check valve 30 and provides redundant protection from contamination of potable water 18.

A potable water check valve supply line 34 transmits potable water 18 from the potable water valve 36 to the second potable water check valve 32. The potable water valve 36 preferably is electrically activated as discussed below concerning FIG. 3 to select or to deselect potable water 18 as the flush water 14. The potable water valve 36 when in the closed position provides redundancy to prevent contamination of potable water 18 by sewage 16 or by seawater 4.

A potable water valve supply line 38 transmits potable water 18 from a potable water shutoff valve 40 to the potable water valve 36. The potable water shutoff valve 40 provides a manual means for shutting off the flow of potable water 18. A potable water shutoff valve supply line 42 transmits potable water 18 from the pressurized source of potable water 44 to the potable water shutoff valve 40.

A seawater pump discharge line 46 transmits seawater 4 from the seawater pump 48 to the "T" connector 26 when seawater 4 is selected as the flush water 14. When seawater 4 is selected as the flush water 14 as described below and illustrated by FIG. 3, the seawater pump 48 provides pressure to pump seawater 4 to the toilet 6. A seawater pump supply line 50 transmits seawater 4 from the seawater strainer 52 to the seawater pump 48. The seawater strainer 52 removes debris from the seawater 4 to reduce odor and staining of the toilet 6.

A seawater strainer supply line 54 transmits seawater 4 from the seawater check valve 56 to the seawater strainer 52. The seawater check valve 56 prevents the loss of potable water 18 when potable water 18 is selected as the flush water 14.

Seawater check valve supply line 58 transmits seawater 4 from seacock 60 to seawater check valve 56. Seacock 60 allows the seawater 4 to be manually shut off. A seacock supply line 62 transmits seawater 4 from the seawater intake 64 to the seacock 60.

All water supply lines are preferably flexible tubing three quarters of an inch in diameter. Each end of each water line is preferably secured using tubing clamps.

Figure 2:
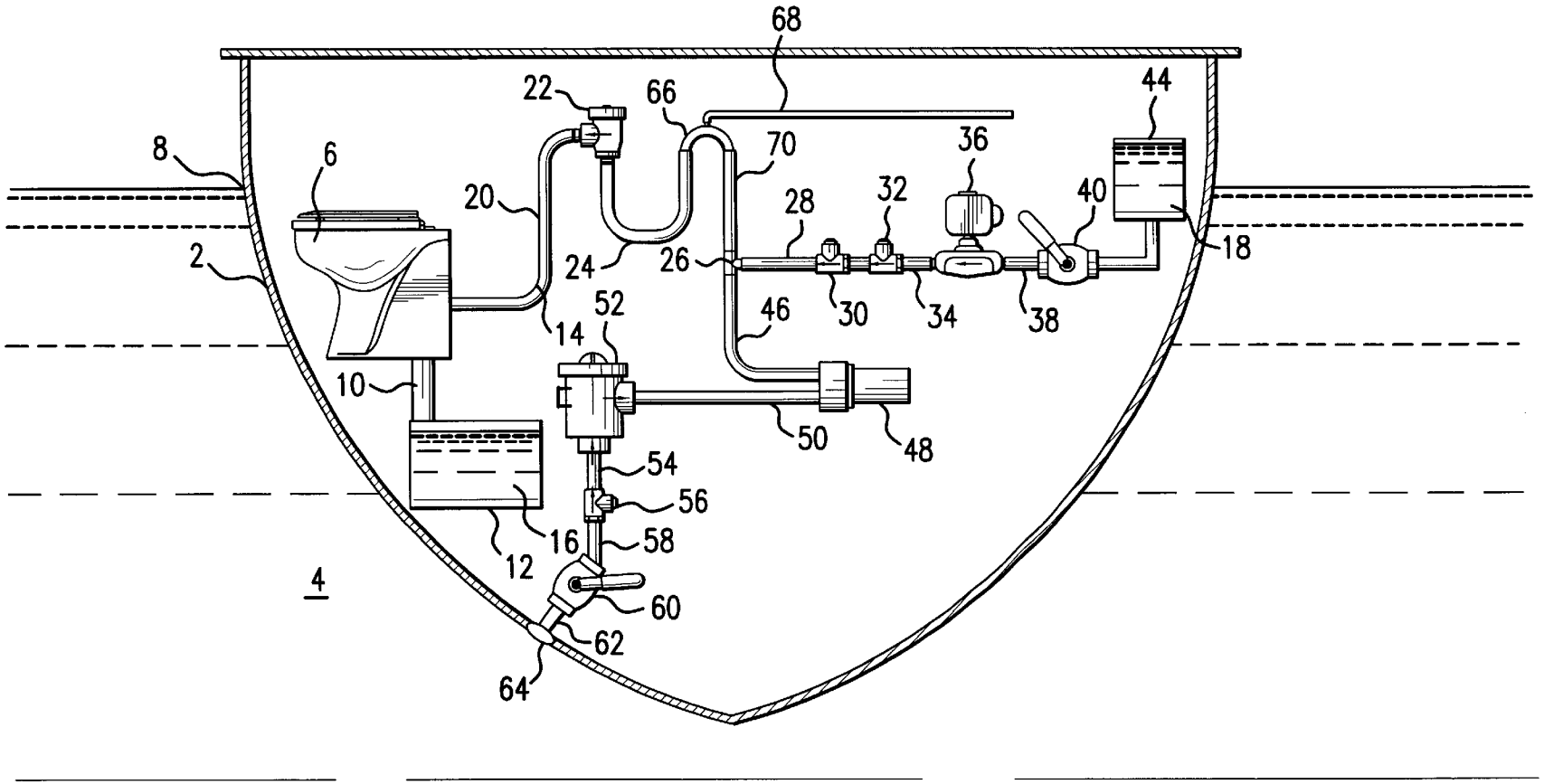
FIG. 2 is a plumbing diagram of the preferred embodiment where the toilet is installed below the water line of a marine vessel.

FIG. 2 is a plumbing diagram of the preferred embodiment where the marine toilet 6 is installed below the waterline 8 of the vessel 2. In this embodiment, the vacuum breaker supply line 24 transmits flush water 14 from a vented loop 66 to the vacuum breaker 22. The vented loop 66 includes a vent tube 68. The vented loop 66 and vent tube 68 ensure that the static pressure of the seawater 4 does not cause seawater 4 to continually flow into the toilet 6 when the toilet 6 is below the waterline 8. A vented loop supply line 70 transmits the selected flush water 14 from the "T" connection to the vented loop 66. In other respects, the embodiment of FIG. 2 is identical to that of FIG. 1.

Figure 3:
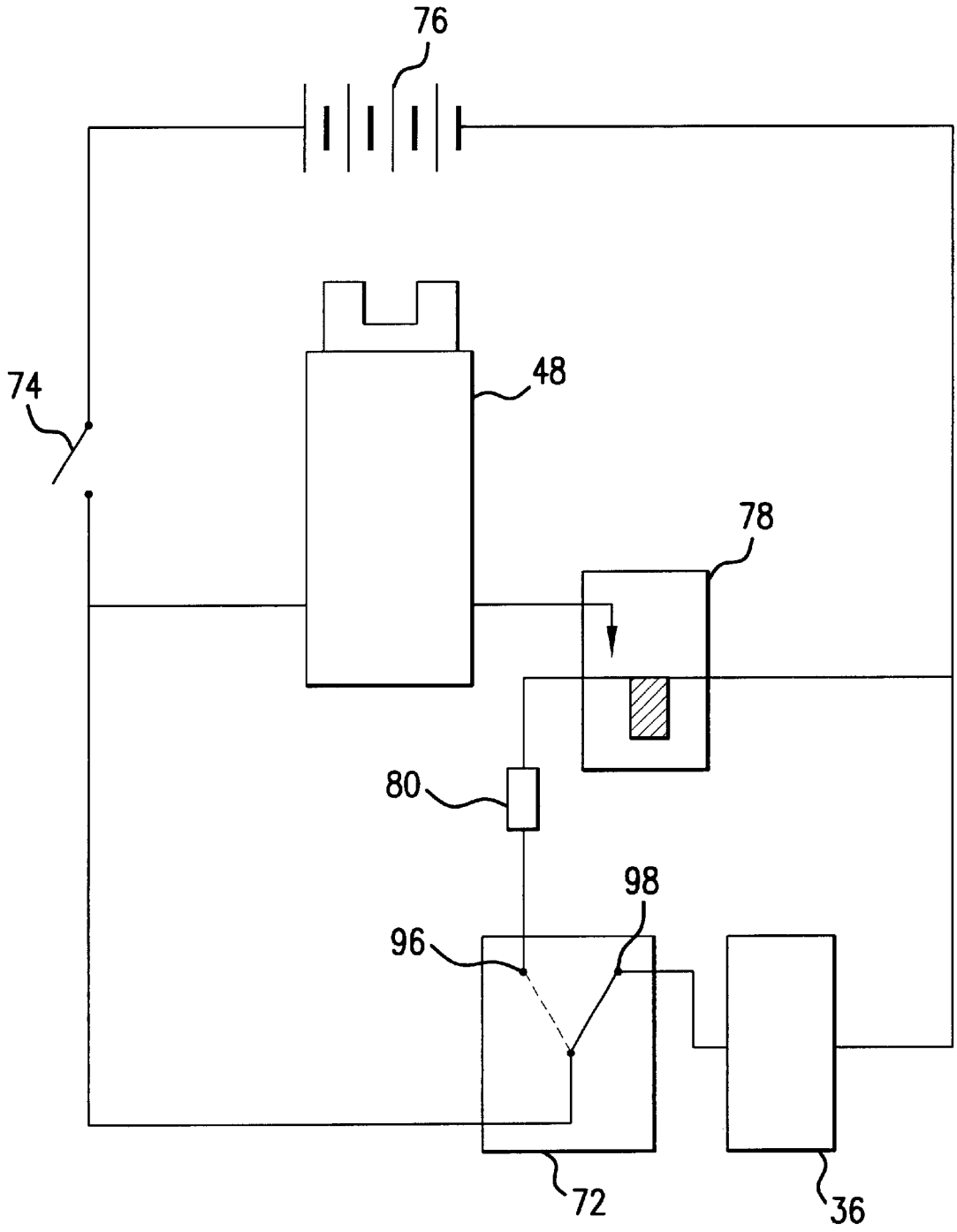
FIG. 3 is wiring diagram for a typical installation of the apparatus using an electrically operated toilet.

FIG. 3 shows a typical wiring diagram of the preferred embodiment. A flush water selector switch 72 is provided having two positions. A normally open toilet activation switch 74 also is provided. When the flush water selector switch 72 is in a first position 98 and the toilet activation switch 74 is simultaneously closed, an electrical circuit is completed between power supply 76 and potable water valve 36. Electrical power flowing through the circuit opens potable water valve 36 using a solenoid or by any other suitable means. Potable water 18 flows from the pressurized potable water supply 44 through the open potable water valve 36, through the first and second potable water check valves 30, 32, through the "T" connector 26, through the vacuum breaker 22, and to the toilet 6 as flush water 14. Potable water 18 is prevented by the seawater check valve 56 from flowing through the seawater pump 48 and out the seawater intake 64.

When the flush water selector switch 72 is in the second position 96 and the toilet 6 actuation switch is simultaneously closed, a normally open relay 78 is energized by a power supply 76. The relay 78 is then closed, completing an electrical circuit between the power supply 76 and the seawater pump 48. The seawater pump 48 is thus activated, pumping seawater 4 from the seawater intake 64 through the seawater check valve 56 and seawater strainer 52, through the "T" connector 26, through the vacuum breaker 22 and to the toilet 6 as flush water 14. The seawater 4 is prevented from entering the potable water supply 44 by the first and second potable water 18 check valves and by the potable water valve 36. The normally open relay 78 is protected by a fuse 80.

Figure 4:
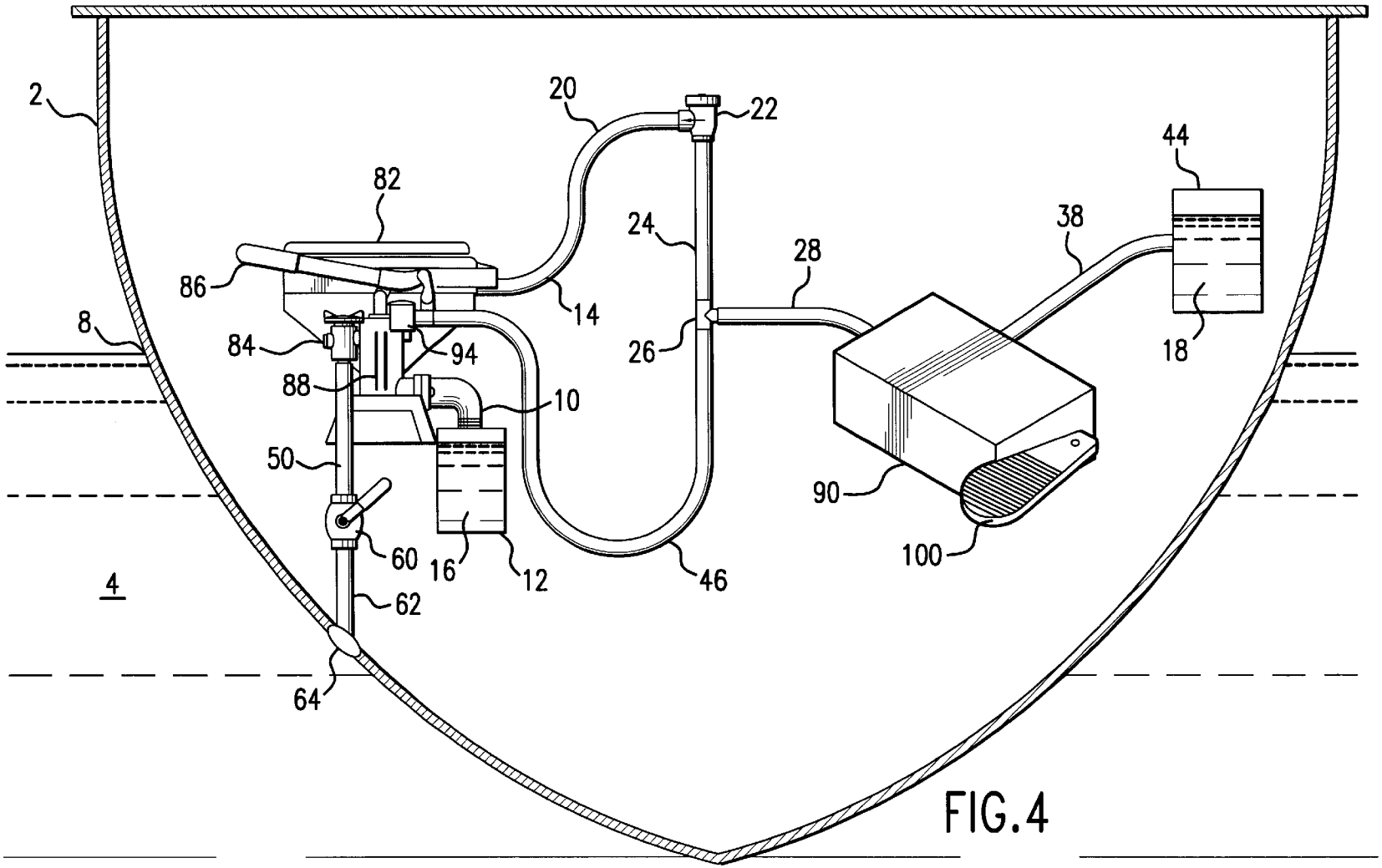
FIG. 4 is a plumbing diagram of an alternative embodiment where a manually-operated marine toilet is installed above the water line of a marine vessel.

FIG. 4 illustrates an alternative embodiment utilizing a manual marine toilet 82 in an installation above the waterline 8 of a vessel 2. A manual toilet 82 discharges sewage 16 through a toilet discharge line 10 to a sewage holding tank 12. A flush water supply line 20 transmits selected flush water 14, either seawater 4 or potable water 18, from a vacuum breaker 22. A vacuum breaker supply line 24 transmits selected flush water 14 from a "T" connector 26 to the vacuum breaker 22.

To select seawater 4 as the flush water 14, a flush-to-dry valve 84 is opened to allow flow of seawater 4. A manual pump lever 86 is operated to activate a manual pump 88. The manual pump 88 draws seawater 4 through a seawater intake 64, through a seawater intake 64 line, through the flush-to-dry valve 84 and into the manual pump 88. The seawater 4 is then forced under pressure through a manual seawater pump check valve 94, through a seawater pump discharge line 46 to the "T" connector 26, through the vacuum breaker 22, through the toilet 6 supply line and into the toilet 6 as flush water 14.

Figure 5:
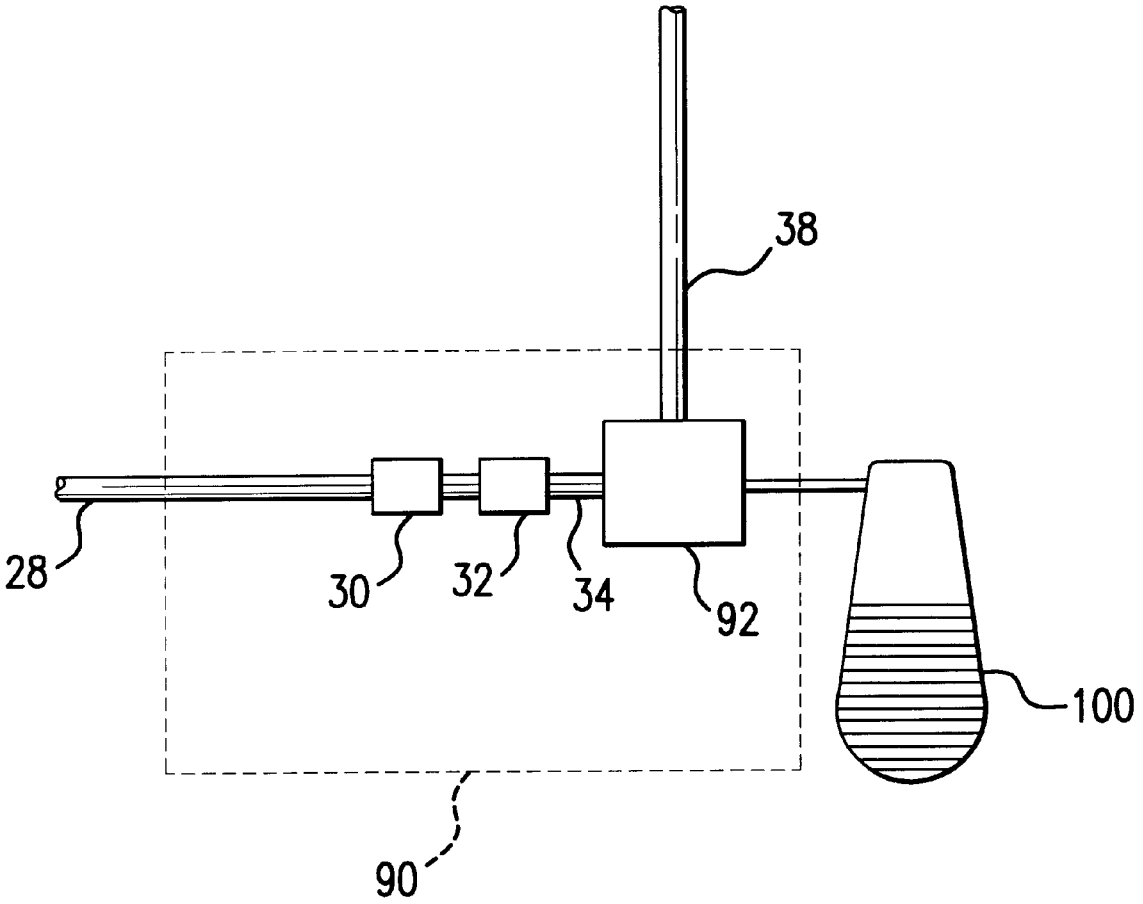
FIG. 5 is a detail of a manual pedal-operated potable water valve and check valve assembly.

To select potable water 18 as the flush water 14 in the manual toilet 82 embodiment of FIG. 4, a pedal-operated water valve 90 is provided. As shown by FIG. 5, the pedal-operated water valve 90 is an assembly including a pedal 100, a manual potable water valve 92 operated by the pedal 100, a first potable water check valve 30 and a second potable water check valve 32. Depression of the pedal 100 opens the potable water valve 92 allowing potable water 18 to flow from the pressurized potable water supply 44 through the first and second potable water check valves 30 and 32 and hence to the "T" connector 26 (FIG. 4). Potable water 18 flows through the "T" connector 26, through the vacuum breaker 22, through the flush water supply line 20 and to the manual toilet 82 as flush water 14.

In the preferred embodiment of FIG. 4, the manual pump 88 is a compound pump, which is well known in the art of manual marine toilets 82. One side of the piston of the manual pump 88 serves to pump seawater 4. The other side of the piston pumps sewage 16 from the manual toilet 82. When potable water 18 is selected as flush water 14, the manual pump 88 is operated to clear sewage 16 from the manual toilet 82. To prevent the manual pump 88 from attempting to pump seawater 4 when potable water 18 is selected, the flush-to-dry valve 84 is closed, preventing seawater 4 from entering the pump 88 and venting the seawater side of the pump 88 to the atmosphere.

The present invention utilizes a pressurized potable water supply 44. The potable water supply 44 may be pressurized by any of the methods known in the art, including use of an electrical pump or elevating the potable water supply 44.

I claim:

1. An apparatus for selecting flush water for a marine toilet comprising:

a. a source of potable water;

b. a potable water valve hydraulically connecting said potable water source and said toilet;

c. a source of seawater;

d. a seawater pump hydraulically connecting said seawater source and said toilet;

e. means for selecting either said seawater source or said potable water source for flushing said toilet.

2. The apparatus of claim 1, further comprising a vacuum breaker hydraulically connected between said toilet and said potable water source and said seawater source to prevent contamination of said seawater source and said potable water source by sewage from said toilet.

3. The apparatus of claim 1, said toilet being below the water line of a marine vessel, the apparatus further comprising a flush water supply line transmitting seawater from the seawater source to the toilet, said flush water supply line including a vented loop above said vessel's waterline to prevent overflow of the toilet due to static pressure of the seawater.

4. The apparatus of claim 1, said seawater pump being manually operated, and said potable water valve comprising a manual potable water valve assembly.

5. An apparatus for selecting flush water for a marine toilet comprising:

a. a source of potable water;

b. a potable water valve hydraulically connecting said potable water source and said toilet;

c. a source of seawater;

d. a seawater pump hydraulically connecting said seawater source and said toilet;

e. said potable water valve and said seawater pump being electrically activated, the apparatus further comprising:

f. a source of electrical power;

g. an electrical switch having a first and a second position, said switch electrically connecting said power supply to said potable water valve and to said seawater pump;

h. said switch when in said first position activating said potable water valve to allow the flow of potable water from said potable water source to said toilet and deactivating said seawater pump to prevent the flow of seawater from said seawater source to said toilet;

i. said switch when in the second position activating said seawater pump to allow the flow of seawater from said seawater source to said toilet and deactivating said potable water valve to prevent the flow of potable water from said potable water source to said toilet.

6. An apparatus for selecting flush water for a marine toilet comprising:

a. a source of potable water;

b. a potable water valve hydraulically connecting said potable water source and said toilet;

c. a source of seawater;

d. a seawater pump hydraulically connecting said seawater source and said toilet;

e. a vacuum breaker hydraulically connected between said toilet and said potable water source and said seawater source to prevent contamination of said seawater source and said potable water source by sewage from said toilet;

f. a plurality of check valves hydraulically connecting the potable water source and the seawater source and preventing entry of seawater into the potable water source.

7. The apparatus of claim 4, further comprising a check valve hydraulically connecting the potable water source and the seawater source and preventing flow of potable water into the seawater source.

8. The apparatus of claim 5, said apparatus further comprising a strainer hydraulically connecting said seawater source and said toilet, said strainer removing relatively large objects from the seawater passing to said toilet.

9. An apparatus for selecting flush water for a marine toilet comprising:

a. a source of potable water;

b. a potable water valve hydraulically connecting said potable water source and said toilet;

c. a source of seawater;

d. a seawater pump hydraulically connecting said seawater source and said toilet;

e. said seawater pump being manually operated, and said potable water valve comprising a manual potable water valve assembly;

f. said source of seawater and said source of potable water being in hydraulic communication, said manual potable water valve assembly comprising:

g. a foot-pedal operated manual potable water valve communicating with said potable water source and controlling the flow of potable water;

h. a plurality of potable water check valves communicating between said manual potable water valve and said source of seawater and preventing contamination of the potable water source by seawater.

10. The apparatus of claim 9, the manual seawater pump being a compound seawater and sewage pump, the manual potable water valve assembly being adapted so that the pedal-operated manual potable water valve may be operated to allow the flow of potable water to the toilet at the same time that the manual seawater pump is operated to pump sewage from the toilet.

11. The apparatus of claim 10, the manual seawater pump being a compound seawater and sewage pump, the apparatus further comprising a flush-to-dry valve communicating between the seawater source and the intake side of the manual seawater pump to allow manual shut off of the source of seawater and to selectably vent the intake side of the manual seawater pump to the atmosphere to reduce sewage pumping effort when potable water is selected as the flush water.

12. An apparatus for selecting flush water for a marine vessel toilet comprising:

a. a source of potable water connected to said toilet;

b. a source of seawater connected to said toilet; and c. means for selecting either said seawater source or said potable water source as the flush water for flushing said toilet.

13. The apparatus of claim 12, further comprising means for preventing sewage contamination of said source of seawater and of said source of potable water.

14. The apparatus of claim 13, the means for preventing sewage contamination of said seawater source and said potable water source comprising a vacuum breaker transmitting flush water from said potable water source and said seawater source to said toilet.

15. The apparatus of claim 14, said source of potable water being in communication with said source of seawater, further comprising means for preventing contamination of the potable water source by seawater from the seawater source.

16. The apparatus of claim 12, said toilet being below the water line of a marine vessel, the apparatus further comprising a flush water supply line transmitting seawater from the seawater supply to the toilet, said flush water supply line including a vented loop above the vessel's waterline to prevent overflow of the toilet due to static pressure of the seawater.

17. An apparatus for selecting flush water for a marine vessel toilet comprising:

a. a source of potable water connected to said toilet;

b. a source of seawater connected to said toilet; and c. means for selecting either said seawater source or said potable water source as the flush water for said toilet;

d. means for preventing sewage contamination of said source of seawater and of said source of potable water; said means for preventing sewage contamination of said seawater source and said potable water source comprising a vacuum breaker transmitting flush water from said potable water source and said seawater source to said toilet;

e. said source of potable water being in communication with said source of seawater, further comprising means for preventing contamination of the potable water source by seawater from the seawater source;

f. said means for preventing contamination of the potable water source by seawater comprising a plurality of check valves hydraulically connected between the potable water source and the seawater source.

18. An apparatus for selecting flush water for a marine vessel toilet comprising:

a. a source of potable water connected to said toilet;

b. a source of seawater connected to said toilet; and c. means for selecting either said seawater source or said potable water source as the flush water for said toilet;

d. said source of potable water being pressurized and said seawater source being the seawater in which the vessel floats.

19. The apparatus of claim 17, said means for selecting seawater or potable water comprising:

a. a source of electrical power;

b. an electrical switch electrically connected to said source of electrical power and having a first and a second position;

b. an electrically operated potable water valve electrically connected to said power source by said switch, said potable water valve hydraulically communicating between said pressurized potable water source and said toilet;

c. an electrically operated seawater pump electrically connected to said power source by said switch, said seawater pump hydraulically communicating between said seawater source and said toilet;

said switch when in said first position activating said potable water valve to allow the flow of potable water from said potable water source to said toilet and deactivating said seawater pump, preventing the flow of seawater from said seawater source to said toilet;

said switch when in the second position activating said seawater pump to allow the flow of seawater from the seawater source to said toilet and deactivating said potable water valve to prevent the flow of potable water from said potable water source to said toilet.

20. The apparatus of claim 17, said means for selecting seawater or potable water comprising:

a. a manual seawater pump hydraulically communicating between said seawater source and said toilet; and b. a manual potable water valve assembly hydraulically communicating between said potable water source and said toilet.

21. The apparatus of claim 20, said source of seawater and said source of potable water being in hydraulic communication, said manual potable water valve assembly comprising:

a. a foot-pedal operated manual potable water valve communicating with said potable water source and controlling the flow of potable water;

b. a plurality of potable water check valves communicating between said manual potable water valve and said source of seawater and preventing contamination of the potable water source by seawater.

22. The apparatus of claim 21, the manual seawater pump being a compound seawater and sewage pump, the manual potable water valve assembly being adapted so that the pedal-operated valve may be operated to allow the flow of potable water to the toilet at the same time that the compound pump is operated to pump sewage from the toilet.

23. The apparatus of claim 22, the manual seawater pump being a compound seawater and sewage pump, the apparatus further comprising a flush-to-dry valve communicating between the seawater supply and the seawater intake side of the manual seawater pump to allow manual shut off of the source of seawater and to selectably vent the intake side of the manual seawater pump to the atmosphere to reduce sewage pumping effort when potable water is selected as the flush water.

24. An apparatus for selecting flush water for a marine vessel toilet comprising:

a. a source of potable water connected to said toilet;

b. a source of seawater connected to said toilet; and c. means for selecting either said seawater source or said potable water source as the flush water for said toilet;

d. said source of seawater and said source of potable water being in hydraulic communication, e. said apparatus further comprising a seawater check valve communicating between said seawater source and said potable water source and preventing potable water from flowing into said seawater source when potable water is selected as the flush water.

* * * * *